US006503121B1

(12) United States Patent
Caffrey

(10) Patent No.: US 6,503,121 B1
(45) Date of Patent: Jan. 7, 2003

(54) AERIAL TOP HAVING A STEPPED AXLE AND A VARIED DIAMETER TETHER

(76) Inventor: Michael S. Caffrey, Apt. D301, 223 5th Ave., S., Kirkland, WA (US) 98033

( * ) Notice: Subject to any disclaimer, the term of this patent is extended or adjusted under 35 U.S.C. 154(b) by 0 days.

(21) Appl. No.: 09/535,054

(22) Filed: Mar. 24, 2000

(51) Int. Cl.[7] ..... A63H 1/30
(52) U.S. Cl. ..... 446/247; 446/261
(58) Field of Search ..... 446/247, 248, 446/250, 251, 252, 253, 254, 256, 258, 259, 261, 262

(56) References Cited

U.S. PATENT DOCUMENTS

| | | | | |
|---|---|---|---|---|
| 2,610,439 A | * | 9/1952 | Nemeth | 446/250 |
| 2,629,202 A | | 2/1953 | Stivers et al. | |
| 2,773,328 A | * | 12/1956 | Fraenkel et al. | 446/250 |
| 3,953,936 A | | 5/1976 | Ennis | |
| 4,130,962 A | | 12/1978 | Ennis | |
| 4,437,261 A | | 3/1984 | MacCarthy | |
| 4,442,625 A | | 4/1984 | MacCarthy | |
| 4,492,057 A | * | 1/1985 | MacCarthy | 446/250 |
| 4,895,547 A | | 1/1990 | Amaral | |
| 5,017,172 A | | 5/1991 | Seifert | |
| 5,100,361 A | | 3/1992 | Kuhn et al. | |
| 5,389,029 A | | 2/1995 | McAvoy | |
| 5,769,686 A | | 6/1998 | Duncan et al. | |
| 5,813,897 A | | 9/1998 | Van Dan Elzen et al. | |

* cited by examiner

*Primary Examiner*—Jacob K. Ackun
(74) *Attorney, Agent, or Firm*—ipsolon llp

(57) ABSTRACT

An improved aerial top, or yo-yo, having a stepped axle and a varied diameter tether is disclosed. The stepped axle is coupled at distal ends to yo-yo body halves and maintains the yo-yo body halves in a space apart arrangement and defines a channel between the body halves. The stepped axle has distal end portions having relatively large diameters and a central axle portion having a relatively smaller diameter. The stepped axle may be provided with intermediate axle portions having intermediate sized diameters. Sidewalls separate the axle portions and the sidewalls may be orthogonal to surfaces of the axle portions, or oblique thereto. A tether is wound onto the stepped axle and a user uses a throwing motion while the tether is connected to the user's finger, to throw the yo-yo so that the yo-yo unwinds the tether. The tether is a cord having a varied diameter along its length. The cord may have distinct portions and each portion has a constant diameter along its length, or the cord may have a tapered diameter. The cord portion having the smallest diameter is coupled to the central axle portion.

32 Claims, 2 Drawing Sheets

AERIAL TOP HAVING A STEPPED AXLE AND A VARIED DIAMETER TETHER

BACKGROUND OF THE INVENTION

1. Field of the Invention

This invention pertains to tethered aerial tops.

2. Description of the Related Art

Aerial tops, colloquially known as yo-yos, generally consist of body halves separated by an intermediate axle. A tether encircles, and extends from, the axle for coupling the yo-yo to a user's hand, imparting rotational motion to the top, and general control of the yo-yo. As is known, the body halves are generally thick, circular discs having a diameter in the range of four to ten centimeters, but more commonly in the range of five to six centimeters. The discs are commonly one to two centimeters thick. The discs are coupled to the axle so as to be separated from one-another by one-half to one centimeter. The tether is commonly a cord of twisted strands about 42 inches (1.07 m) in length and includes a looped end that encircles the yo-yo axle.

In operation, the tether is wound onto the axle and coupled to a user's finger. The user then throws the yo-yo downward and away from the user's body and the restraint force of the tether causes the yo-yo to rotate as it moves away from the user's hand and unwinds the tether. With proper technique, the yo-yo can be made to spin freely when it reaches the end of the tether, a method known in the art as making the yo-yo "sleep."

Many tricks can be performed while the yo-yo is sleeping. As a result, a yo-yo that can be made to sleep a long time is preferable over a yo-yo that sleeps a relatively shorter time. Several factors affect the sleep time of a yo-yo: the yo-yo's rate of rotation when it reaches the end of the tether, it's moment of inertia, and friction. Friction has several components, including the friction of the string on the axle and air resistance of the rotating body. Thus, sleep time can be increased by increasing the rate of rotation, increasing the moment of inertia (without slowing the rotation rate), or decreasing overall friction.

In Ennis, U.S. Pat. No. 4,130,962, the weight of the yo-yo discs are concentrated in the periphery of the discs to increase the yo-yo's moment of inertia. A rotating body with a high moment of inertia will spin longer than a similar body with a smaller moment of inertia, assuming both have the same initial rate of rotation. Thus, Ennis provides the yo-yo with a relatively large moment of inertia by placing the weight of the yo-yo near the periphery of the body discs.

Caffrey, U.S. Pat. No. 4,332,102, provides a yo-yo with reduced frictional drag between the yo-yo tether and the axle by attaching the tether to a bearing-pulley located around the axle. Placing a bearing between the tether and the axle increases the spinning time of the yo-yo by decreasing friction. In order to provide the user with a means to retrieve the yo-yo, that is, cause the yo-yo to grab the string and use its rotational momentum to wind itself onto the tether, the invention provides centrifugally operated clutches that engage the sides of the bearing-pulley and the clutches engage the bearing-pulley as the yo-yo's rotational speed falls below a predetermined speed.

Thus, it is apparent there is a desire to enhanced a time of free spinning to perform yo-yo tricks and to better enjoy the toy.

SUMMARY OF THE INVENTION

The present invention improves upon the prior art by providing an aerial top having a stepped axle that extends between first and second body portions and a tether having a varied diameter along its length. The stepped axle includes distal end portions with a first diameter and a central portion with a second, smaller diameter. The end portions are separated from the central portion by annular sidewalls. The tether is coupled to the central portion of the stepped axle and includes a loop for connection to a user's finger at its other end.

Preferably, the annular walls between the axle end and central portions are substantially orthogonal to surfaces of the axle end and central portions, respectively. Alternatively, the annular sidewalls may be oblique to the axle portion surfaces.

In preferred embodiments, the tether is a cord having different portions of different diameters. A portion with a smallest diameter is located nearest the yo-yo, and a portion with a largest diameter is located furthest from the yo-yo. In an alternative embodiment, the tether is tapered from a relatively large diameter to a relatively smaller diameter at a tether end that is coupled to the yo-yo.

In preferred operation, the tether is wound onto the axle such that the thinnest diameter tether portion is wound onto the axle central portion and the larger diameter tether portion is wound onto the axle end portions. Thus, taking advantage of an increased moment arm due to the large diameter axle end portions, and conservation of angular momentum, the yo-yo of the present invention provides advantages over the prior art.

DETAILED DESCRIPTION OF THE PREFERRED EMBODIMENTS

The Holy Grail of yo-yos is long sleep time. Relatively, higher rotational speeds provide longer sleep time and allow the user to execute more tricks such as 'Walk the Dog,' and 'Rock the Baby.'

In typical use, a yo-yo tether is attached to a user's finger and to a yo-yo axle, and is wound around the axle. The user throws the yo-yo downward and outward while an end of the tether is attached to the hand. Moment forces. or torque, spin the yo-yo body to allow the tether to unwind. When the tether is fully extended, the yo-yo body either spins on the extended tether, or rewinds onto the tether. To perform most yo-yo tricks, the yo-yo body is caused to spin at the end of the extended tether. The greater the rotational speed of the yo-yo body, the longer the yo-yo can spin and the user can perform more advanced yo-yo tricks. The present invention provides a yo-yo that can provide greater rotational speed of the yo-yo body.

With reference to FIGS. 1–5, preferred embodiments of the present invention are described.

Figure 5:
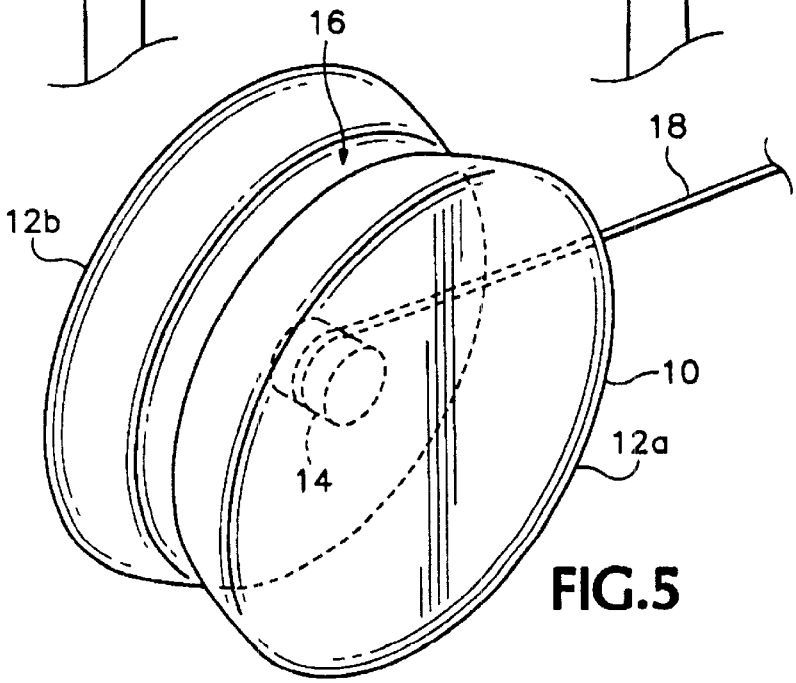
FIG. 5 a perspective view of a yo-yo of the present invention showing the hidden axle and some hidden body halve portions and tether portions in dashed lines.

FIG. 5 is a perspective view of a yo-yo 10 having first and second body halves 12*a* and 12*b*. The body halves 12*a* and 12*b* are held in facing, spaced-apart orientation by an axle 14 so as to form an annular channel 16 between the body halves. The axle 14 is fixedly connected to the body halves at distal ends of the axle. A tether 18 is coupled to the axle and extends from the axle through the channel 16 and outward. The tether 18 includes a loop (not shown) at its outward end for connecting to a user's finger for normal use as is known in the art.

Figure 1:
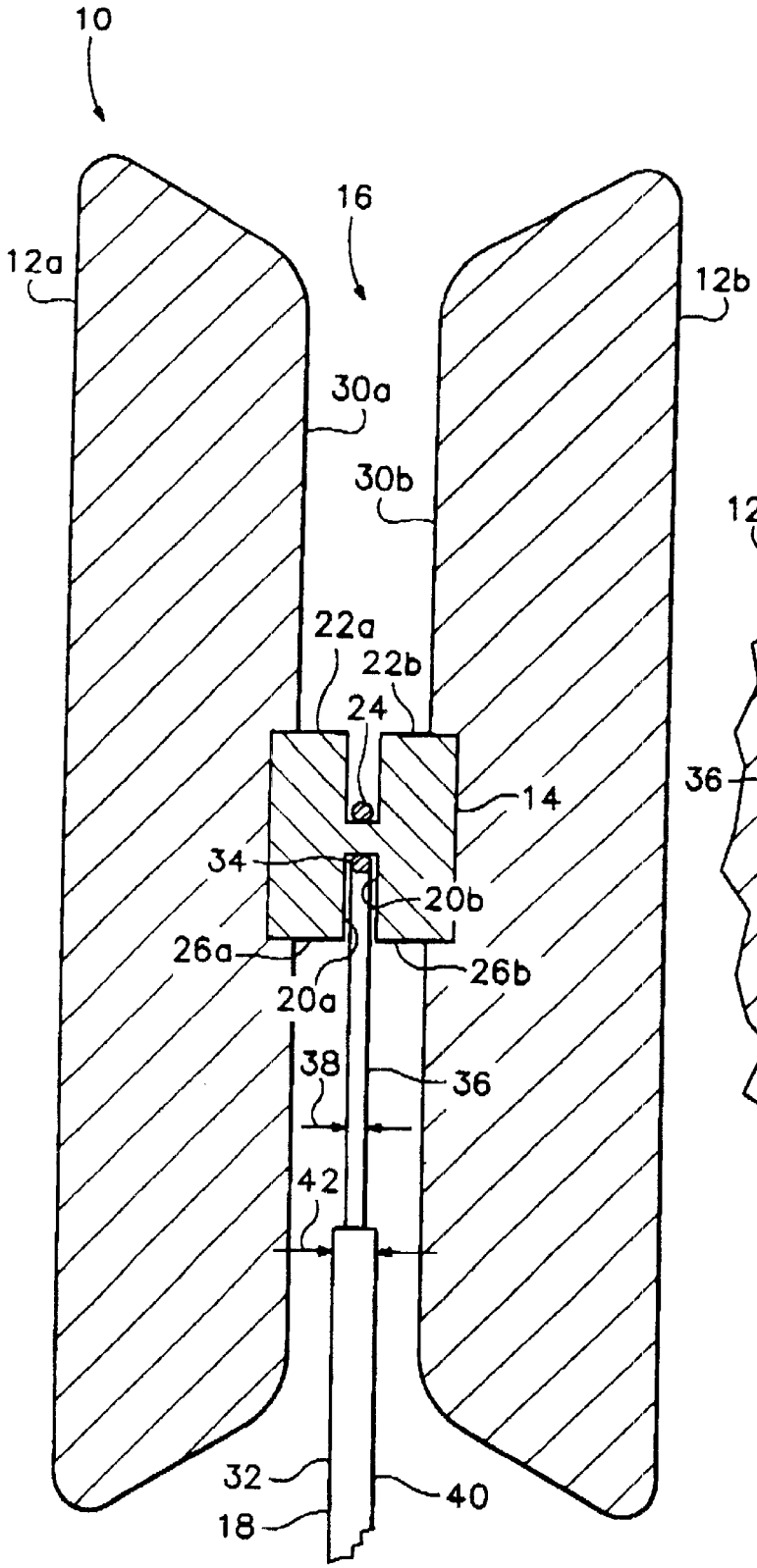
FIG. 1 is a cross-section view of a yo-yo of the present invention showing a first embodiment of yo-yo body halves, an axle, and a tether.

FIG. 1 shows the yo-yo 10 of the present invention in cross-section elevation having a first preferred embodiment for the axle 14 and tether 18. The axle 14 is a stepped axle, having annular sidewalls 20*a* and 20*b* located between axle portions 22*a*, 22*b*, and 24. Axle portions 22*a* and 22*b* are axle end portions located at distal ends of the axle 14. The axle end portions 22*a* and 22*b* have a first diameter—the diameter being the largest distance across a cross-section of an axle portion.

Axle portion 24 is a central portion, located between the axle end portions 22*a* and 22*b*, and has a second diameter that is smaller than the first diameter of the axle end portions 22*a*, 22*b*. The diameters of the axle portions 22 and 24 are selected so that all of a first tether portion 36 (described below) can wind entirely onto the axle central portion 24 without winding onto the axle end portions 22.

Figure 2:
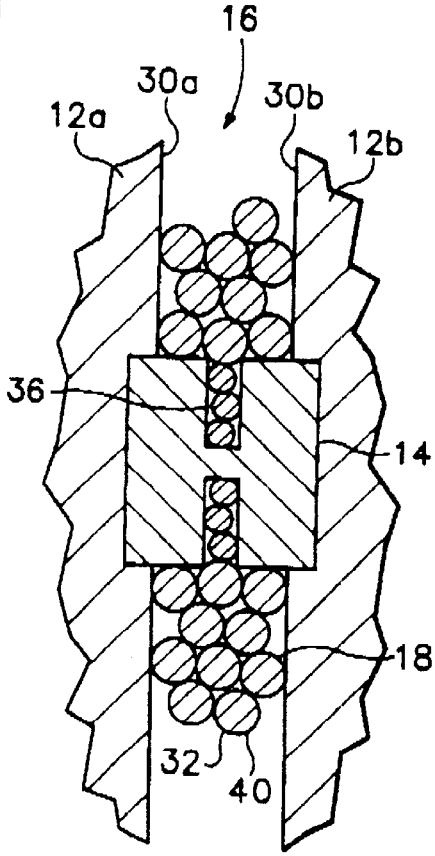
FIG. 2 is an enlarged cross-section view of the yo-yo of FIG. 1 in which the tether has been wound onto the yo-yo axle.

In the first embodiment of FIGS. 1 and 2, the annular sidewalls 20*a* and 20*b* are panar and substantially orthogonal to surfaces 26*a* and 26*b* of the axle end portions 22*a* and 22*b*, and to a surface 28 of the axle central portion 24.

Figure 3:
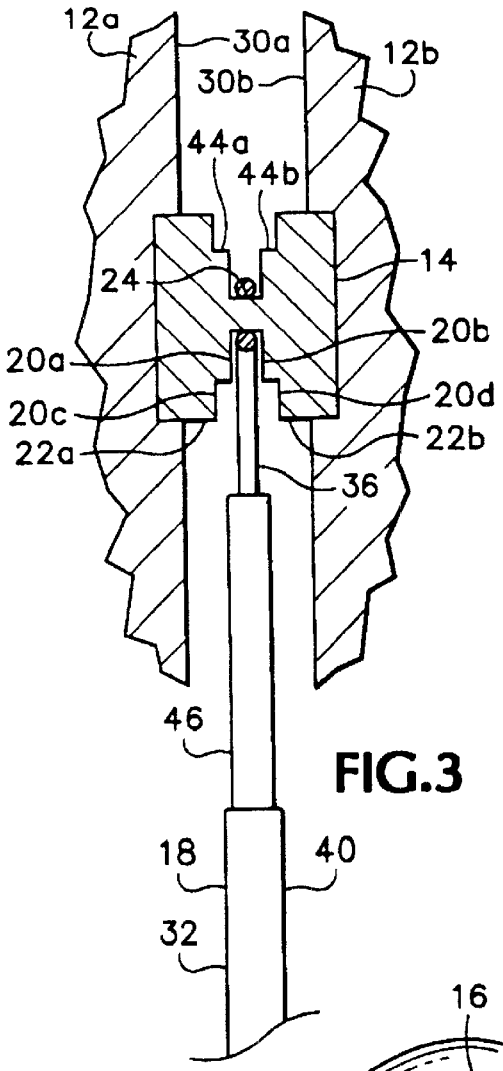
FIG. 3 is an enlarged cross-section of a yo-yo of the present invention showing a second embodiment.

In an alternative embodiment, shown in FIG. 3, the stepped axle 14 includes four annular sidewalls, 20*a*, 20*b*, 20*c*, and 20*d* that are substantially orthogonal to the surfaces 26*a* and 26*b* of the axle end portions 22*a* and 22*b* and the surface 28 of the central portion 24. In another alternative embodiment, shown in FIG. 4, the annular sidewalls 20*a* and 20*b* are oblique to the axle end portion's surfaces 26*a*, 26*b* and the central portion surface 28. In the embodiments of FIGS. 1–4, the annular sidewalls 20*a* and 20*b* (and 20*c* and 20*d*, where shown) are substantially planar.

In the preferred embodiments, the surfaces 26*a* and 26*b* of the axle end portions 22*a* and 22*b* are textured to assist with engaging the tether. A diamond, or crosshatch, texture pattern is formed on the surfaces 26*a* and 26*b*. The textured area begins at the junction of the body halves 12*a* and 12*b*, respectively, and extends toward the axle central portion, but stops just before reaching the junction of the surfaces 26*a* and 26*b* and the sidewalls 20*a* and 20*b*, respectively. In this embodiment, where the axle is fixedly coupled to the body halves 12 and 12*b*, the axle central portion 24 has a smooth surface so that the axle can slide easily on the tether while the yo-yo sleeps.

Returning to the first embodiment of FIGS. 1 and 2, the central portion 24 has a length $L_c$ that is the distance between the annular sidewalls 20*a* and 20*b*. The axle end portions 22*a* and 22*b* are fixedly coupled to respective body halves 12*a* and 12*b*. The axle 14 maintains the body halves 12*a* and 12*b* in spaced-apart orientation wherein opposing annular faces 30*a* and 30*b* of the body halves 12*a* and 12*b* are substantially parallel. A space between the annular faces 30*a* and 30*b* is the channel 16.

The first embodiment includes the tether 18. The tether of this embodiment is a cord 32 having plural strands (not separately shown) that are wound together. Macroscopically, the cord 32 appears generally round in cross-section. However, an enlarged cross-sectional view would reveal that the cross-section does not have a circular perimeter, but rather has an irregular perimeter. But, because the cord comprises twisted strands, a view of the cross-section would show the strands twisting off to the back, from the observer's reference, creating an overall circular appearance. Accordingly, the cord 32 of the present invention is referred to as round or cylindrical, having a substantially circular cross section.

The cord 32 of the present invention has a diameter associated with its cross-section. In the present context, the diameter of the cord is the diameter of the smallest circle that encompass the cross section of the cord. Other references to circle geometry, such as radii, also relate to the smallest circle that encompasses the cord cross section.

Referring again to the first embodiment specifically, the tether 18 has a first end 34 that is coupled to the axle 14. Extending back from, and including, the first end 34, is a first tether portion 36 that has a length $L_{T1}$, and a first diameter 38. In this first embodiment, the first tether portion 36 has a constant diameter 38 along its length $L_{T1}$. Also, the diameter 38 is slightly less than the length $L_c$ of the axle central portion 24 so that the first tether portion 36 can easily wind around the central axle portion. Preferably, the length $L_c$ is 150% to 175% larger than the diameter 38. Yo-yo tethers wear with use, so that the diameters will become smaller in proportion to the amount of use. Thus, the tether diameter 38 and central axle portion length $L_c$ are selected so that new tethers do not contact the sidewalls 20*a* and 20*b* while the yo-yo is sleeping and so that a worn tether diameter 38 does not become less than ½ the length $L_c$. If the tether becomes worn so that its diameter is less than ½ the length $L_c$, then the tether would undesirably wind side-by-side onto the central axle portion 24.

In this first embodiment, the tether 18 includes a second portion 40 that has a length $L_{T2}$ and a diameter 42. The second tether portion 40 is fixedly coupled to the first tether portion 36 and extends to the loop (not shown) that is used to connect the tether to a user's finger. The diameter 42 is constant along the length $L_{T2}$. The diameter 42 is preferably larger than the length $L_c$ of the axle central portion 24 and is on the order of twice the diameter 38 of the first tether portion 36, although other ratios of tether portion diameters may prove to be optimum.

Standard yo-yo tethers are 42 inches (106.7 cm) long. In preliminary designs, the tether portion lengths $L_{T1}$, $L_{T2}$, are related so that, in the case of a two portion tether of this first embodiment, the thicker, second portion 40 is twice as long as the thinner, first portion 36. Thus, X+2X=42 (inches, the standard tether length), leading to X=14 inches (35.56 cm). Therefore, preferably, $L_{T1}$ is 14 inches (35.56 cm) and $L_{T2}$ is 28 inches (71.12 cm) in this first embodiment.

The tether 18 of the first embodiment is shown in FIG. 2 wound onto the axle 14. The first tether portion 36 is wound onto the axle central portion 24 and onto itself after the axle central portion is covered. However, the first tether portion 36 is not wound onto the axle end portions 22. The diameter of the axle end portions 22, or the length $L_{T1}$ of the tether first portion 36, is sized so that the first portion winds onto the axle central portion, and itself, only, and does not wind onto the axle end portions 22. Further, the diameter 42 of the tether second portion 40 is sized larger than the length $L_c$ of the axle central portion 24 and thus does not fit between the annular sidewalls 20*a* and 20*b*. The second tether portion 40 is thus wound onto the axle end portions 22 and onto itself.

The stepped axle has the effect of increasing the radius, or moment arm, of the yo-yo at the point where the tether is wound onto the axle when the user is about to throw the yo-yo to impart rotation. Basic physical relationships reveal that for a given force, the greater radius will induce a greater acceleration. The torque, T, applied to the yo-yo is equal to the moment of inertia, I, times angular acceleration $\alpha$, ($T=Ia$). And, torque, T, equals force F (or string tension) times the radial distance, r, to the point where the tether is tangential to the yo-yo (i.e., $T=Fr$). Because angular velocity, $\omega=\omega_0+\frac{1}{2}$ at (where wo is initial velocity, and t is time), greater acceleration will produce greater angular velocity.

When kinetic energy is created in the yo-yo, and the tether reaches the end of the second portion 40, the tether begins to unwind from the smaller diameter central axle portion 24 to generate greater angular velocity. The effect of the stepped axle is analogous to a derailleur gear system on a racing bicycle. The rear sprocket gear cluster on such a bicycle includes sprocket wheels of different diameter. The cyclist uses the largest rear sprocket to perform the most work to start the bicycle from zero velocity or when ascending a hill. When the bicycle is moving (thus having kinetic energy), the cyclist shifts to a smaller diameter rear sprocket to propel the bicycle faster. Assuming that the cyclist has a predetermined amount of muscle energy to create a force (tension) on the gear chain, then the larger diameter rear sprocket permits an efficient and faster start and the smaller diameter rear permits a greater top end speed.

The tether 18 of the present invention further assists in increasing the rotational speed of the yo-yo through conservation of momentum. Physics teaches that momentum, L, a form or energy, cannot be created or destroyed. Thus, $L=I\omega$=a constant in the absence of external torques acting on the system. This principle is evident in a bullwhip, wherein the whip is weighted and tapered from a thick, heavy handle to a very thin tip.

A bullwhip user uses an arm throwing motion to quickly move the bullwhip handle forward. The tapered whip portion starts behind the bullwhip user and moves forward under the force of the throwing motion. As successive portions of the whip reach a maximum forward location, the remaining amount of whip undergoing motion grows smaller, and accordingly weighs less. Conservation of momentum dictates that as the weight of the whip in motion grows smaller, the moment of inertia, I, shrinks, and the velocity of the whip must increase proportionately. In this manner, a bullwhip user that can achieve a maximum forward throwing velocity of only 15 to 35 m/s can cause the tip of the whip to reach the speed of sound (1460 m/s) when the whip becomes fully extended causing the well-known crack of the whip.

Because the tether 18 of the present invention has different portions 36, 40 with different diameters, 38, 42, the weight of the tether moving forward diminishes as successive portions of the tether reach a termination point of forward motion. Conservation of the momentum requires that the remaining tether portion that is in motion must move faster. The increase in velocity has not been quantified.

The present invention may be incorporated into alternative embodiments. In FIG. 3, the axle 14 includes two steps, so that the axle central portion 24 is separated from the axle end portions 22 by intermediate step portions 44*a* and 44*b*. Accordingly, the axle includes four annular sidewalls 20*a*, 20*b*, 20*c*, and 20*d* that are located at the junction of the axle portions. In the embodiments depicted, the annular sidewalls are substantially orthogonal to the surfaces of the axle portions 22*a*, 22*b*, 24, 44*a*, and 44*b*.

The embodiment of FIG. 3 also shows an alternative embodiment tether 18 having three portions: the first portion 36, the second portion 40, and a middle tether portion 46. The middle tether portion 46 has a diameter 48 that is different than the diameter of the first tether portion 36 and the second tether portion 40.

In preferred operation, the first end tether portion 36 is wound onto the central axle portion 24, the middle tether portion 46 is wound onto the axle intermediate step portions 44*a* and 44*b*, and the second tether portion 40 is wound onto the axle end portions 22*a* and 22*b*. This embodiment provides the advantages of the first embodiment and may provide smoother transition between axle portions for a smoother feel to the yo-yo user. Additional alternative embodiments also include additional axle step portions and tether portions of varied diameter.

In the embodiment of FIG. 3, the surfaces of the axle end portions 22*a* and 22*b*, and the axle intermediate portions 44*a* and 44*b* are preferably textured to assist with engaging the tether. The textured portions on the surfaces of intermediate portions 44*a* and 44*b* end short of the junction of the intermediate portions 44*a* and 44*b* and the sidewalls 20*a* and 20*b* that extend from the axle central portion 24 to prevent inadvertent snagging of the tether on the texture when the user desires to prolong yo-yo sleep time.

The double stepped axle shown in FIG. 3 may be used with the tether of the first embodiment shown in FIGS. 1 and 2. Also, the tether of FIG. 3 may be used with the stepped axle of the first embodiment.

Respective lengths of the tether portions for this embodiment are determined as described above. Thus, $X+2X+3X=42$, and $X=7$, so that the first tether portion length is 7 inches (17.78 cm), the middle tether portion is 14 inches (35.56 cm), and the second tether portion is 21 inches (53.34 cm). In alternative embodiments, the ratios of the lengths of the tether portions may differ.

In this second preferred embodiment, the tether diameters are selected so that the middle tether portion diameter is twice the first portion diameter. The second tether portion diameter is three times the first portion diameter. The selection of tether portion diameters and lengths determines the stepped axle dimensions, which dimensions are selected so that the first tether portion 36 winds onto the axle central portion 24, the middle tether portion 46 winds onto the intermediate step portions 44*a* and 44*b*, and the second tether portion winds onto the axle end portions 20*a* and 20*b*. Additionally, the lengths of the axle portions, i.e., the distance between respective sidewalls 20*a* and 20*b*, or 20*c* and 20*d*, are selected so the desired tether portions fit easily between the intended sidewalls. Thus, as above, the distance between sidewalls 20*a* and 20*b* is approximately 150% to 175% of the diameter of the first tether portion, and the distance between sidewalls 20*c* and 20*d* is approximately 150% to 175% of the diameter of the middle tether portion.

Figure 4:
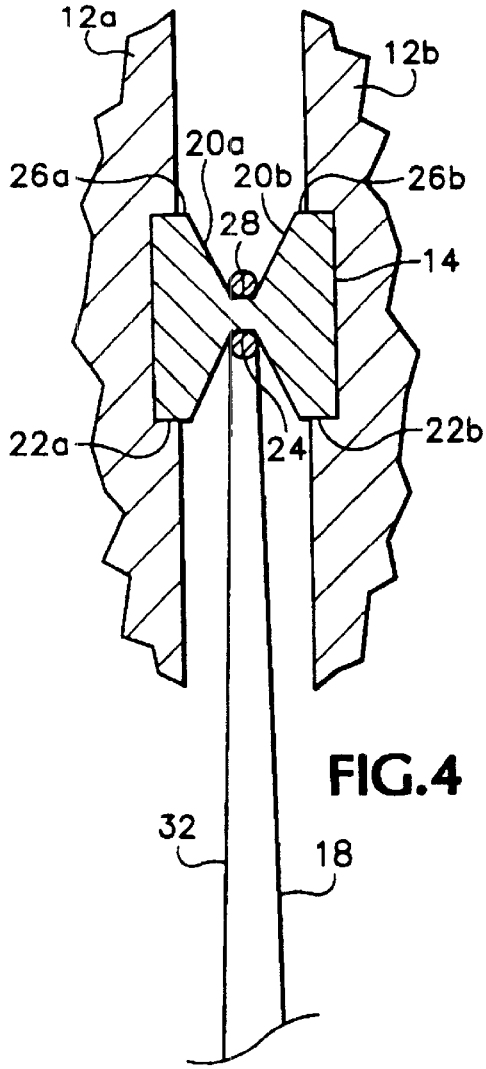
FIG. 4 is an enlarged cross-section of a yo-yo of the present invention showing a third embodiment.

FIG. 4 shows another alternative embodiment having a stepped axle 14 in which the annular sidewalls 20*a* and 20*b* are oblique to the surfaces 26*a*, 26*b*, and 28 of the axle end portions 22 and central portion 24, respectively. Additionally, the tether 18 of this embodiment is tapered along its length, and has no sharply defined tether portions, such as tether portions 36 and 40 of the previous embodiments. In this embodiment, the tether 18 winds onto the central axle portion 24 and rides up the annular sidewalls 20*a* and 20*b*.

The tether 18 of the first embodiment may be used with the stepped axle embodiments of FIG. 3 or 4. Similarly, the tether of FIG. 3 may be used with the stepped axle embodiments of FIG. 1 or 4, and the tether of FIG. 4 may be used with the stepped axle embodiments of FIG. 1 or 3.

Additionally, the present invention may be employed with a free-wheel axle, in which the axle of the present invention is rotatably coupled to the body halves 12*a* and 12*b*. Such rotatable axle couplings are disclosed in Caffrey U.S. Pat. No. 4,332,102.

This specification sets forth the best mode for carrying out the invention as known at the time of filing the patent application and provides sufficient information to enable a person skilled in the art to make and use the invention. The specification further describes materials, shapes, configurations and arrangements of parts for making and using the invention. However, it is intended that the scope of the invention shall be limited only by the language of the claims and the law of the land as pertains to valid U.S. patents.

What is claimed is:

1. An aerial top, comprising:

(a) first and second body portions;

(b) a stepped axle that extends between the first and second body portions and holds the first and second body portions in a spaced-apart arrangement so as to define a first annular channel between the first and second body portions having a first width, and a second annular channel having a second width that is narrower than the first width, the stepped axle having first and second axle end portions with a first diameter and a central portion with a second diameter, wherein the second diameter is smaller than the first diameter, and the first axle end portion is coupled to the first body portion, and the second axle end portion is coupled to the second body portion; and (c) a tether being substantially circular in cross section, the tether having a first portion at a first end with a first tether diameter, and a second portion at a second end with a second tether diameter, the second end being coupled to the central portion of the stepped axle and the second tether diameter being less than the first tether diameter and the first tether diameter being greater than the second width;

(d) wherein the tether is wound onto the stepped axle for use as an aerial top toy.

2. The aerial top of claim 1, wherein the first and second annular walls are substantially orthogonal to the surfaces of the first and second axle end portions, respectively.

3. The aerial top of claim 2, wherein the first and second annular walls are substantially orthogonal to the surface of the axle central portion.

4. The aerial top of claim 1, wherein the surfaces of the first and second axle end portions are textured.

5. The aerial top of claim 1, further comprising a third tether portion having a third diameter, the third tether portion located between, and coupled to, the first and second tether portions.

6. The aerial top of claim 1, wherein the tether has a diameter that tapers from the first diameter to the second diameter.

7. The aerial top of claim 1, wherein the tether second portion is wound onto the central portion and the tether first portion is would onto the first and second axle end portions.

8. The aerial top of claim 1, wherein the annular walls are spaced apart a distance, and the distance is more than 150% of the second diameter of the second portion of the tether, and the distance is less than 175% of the second diameter of the second portion of the tether.

9. An aerial top, comprising:

(a) first and second body portions;

(b) an axle extending between and coupling together the first and second body portions so as to create an annular channel between the first and second body portions, the axle being stepped to define a first annular tether receiving channel having a first width, and a second tether receiving channel having a second width that is greater than the first width; and (c) a tether comprising an elongate cord substantially cylindrical in cross section and having first and second ends, the second end being coupled to the axle, the first end having a first diameter and the second end having a second diameter wherein the second diameter is smaller than the first diameter and the first diameter is greater than the first width, and wherein the tether is wound onto the axle for operating the aerial top.

10. The aerial top of claim 9, wherein the tether comprises first and second tether portions, the first tether portion being located at the first end and the second tether portion being located at the second end, the first tether portion having the first diameter and the second tether portion having the second diameter, and wherein the first and second tether portions are coupled directly together.

11. The aerial top of claim 9, wherein the tether comprises first, second, and third tether portions, the first tether portion being located at the first end and the second tether portion being located at the second end and the third tether portion being located between, and coupled to, the first and second tether portions, the first tether portion having the first diameter along its length, and the second tether portion having the second diameter along its length, and the third tether portion having a third diameter along its length and the third diameter is larger than the second diameter and smaller than the first diameter.

12. The aerial top of claim 9, wherein the cord that has a diameter that tapers from the first diameter to the second diameter.

13. The aerial top of claim 9, wherein the cord comprises twisted strands.

14. The aerial top of claim 9, wherein the axle includes first and second distal portions and a central portion, the first and second distal portions and the central portion are substantially cylindrical, and the first and second distal portions have a first diameter and the central portion has a second diameter that is smaller than the first diameter.

15. The aerial top of claim 14, further comprising first and second annular, planar sidewalls, wherein the first annular, planar sidewall extends between surfaces of the first distal portion and the central portion, and the second annular, planar sidewall extends between surfaces of the second distal portion and the central portion.

16. The aerial top of claim 15, wherein the first and second annular, planar sidewalls are substantially orthogonal to the surfaces of the first and second distal portions.

17. The aerial top of claim 15, wherein the first and second annular, planar sidewalls are substantially oblique to the surfaces of the first and second distal portions.

18. The aerial top of claim 9, wherein the axle includes first and second distal portions, first and second intermediate portions, and a central portion, all axle portions being substantially cylindrical and the first and second distal portions having a first diameter, the first and second intermediate portions having a second diameter that is smaller than the first diameter, and the central portion having a third diameter that smaller than the second diameter.

19. The aerial top of claim 18, further comprising first, second, third, and fourth annular sidewalls, the first sidewall extending between respective surfaces of the first distal portion and the first intermediate portion, the second annular sidewall extending between respective surfaces of the first intermediate portion and the central portion, the third annular sidewall extending between respective surfaces of the second intermediate portion and the central portion, and the fourth annular sidewall extending between respective surfaces of the second distal portion and the second intermediate portion.

20. The aerial top of claim 19, wherein the first, second, third, and fourth annular sidewalls are substantially planar and substantially orthogonal to the surfaces of the axle portions.

21. The aerial top of claim 19, wherein the first, second, third, and fourth annular sidewalls are substantially planar and substantially oblique to the surfaces of the axle portions.

22. An aerial top, comprising:

(a) first and second body portions;

(b) a stepped axle that extends between, and couples together, the first and second body portions, the stepped axle having first and second axle portions with a first diameter and a central portion with a second diameter, wherein the second diameter is smaller than the first diameter, and first and second annular walls wherein the first annular wall extends between respective surfaces of the first axle portion and the central portion, and the second annular wall extends between respective surfaces of the second axle portion and the central portion, and the first and second annular walls define an annular channel therebetween having a first width; and (c) a tether comprising a cord that is substantially cylindrical in cross section and having first and second ends, wherein the first end defines a first diameter and the second end defines a second diameter that is not equal to the first diameter, and wherein the second end is coupled to the stepped axle and arranged so that the tether can be wound on the axle about the central portion and the first and second axle portions for use as an aerial top, and wherein the first diameter of the tether is greater than the first width so that the first end of the tether is prevented from entering the annular channel when the tether is wound on the axle.

23. The aerial top of claim 22, wherein the first and second annular walls are substantially orthogonal to the surfaces of the first and second axle portions, respectively.

24. The aerial top of claim 22, wherein the first and second annular walls are substantially oblique to the surfaces of the first and second axle portions, respectively.

25. The aerial top of claim 22, further comprising third and fourth axle portions that are located outboard of the first and second axle portions, respectively, and further comprising third and fourth annular walls wherein the third annular wall is located between respective surfaces of the third axle portion and the first axle portion, and the fourth annular wall is located between the fourth axle portion and the second axle portion.

26. The aerial top of claim 22, wherein the tether comprises a cord having first and second tether portions wherein the first tether portion has a first diameter and the second tether portion has a second diameter that is smaller than the first diameter.

27. The aerial top of claim 26, further comprising a third tether portion having a third diameter, wherein the third diameter is larger than the first diameter.

28. The aerial top of claim 22, wherein the tether is a cord that has a diameter that tapers from the first diameter to the second diameter.

29. The aerial top of claim 22, where the surfaces of the first and second axle portions are textured to assist with engaging the tether.

30. An aerial top, comprising:

(a) first and second body portions;

(b) an axle extending between and coupling the first and second body portions to create an annular channel therebetween, the annular channel having a first width at a first axle portion and a second width that is less than the first width at a second axle portion; and (c) an elongate substantially cylindrical tether having a first end coupled to the axle, said tether having a first section with a first tether diameter and a second section with a second tether diameter that is different from the first tether diameter and wherein the second tether diameter is greater than the second width.

31. The aerial top according to claim 30 wherein said axle further defines a central section having a first diameter and opposed axle end portions on either side of said central section, said end portions defining a second diameter that is different from the first diameter.

32. The aerial top according to claim 31 wherein the diameter of said second diameter is greater than the diameter of said first diameter.

* * * * *